US009783215B2

(12) United States Patent
Gunzinger et al.

(10) Patent No.: US 9,783,215 B2
(45) Date of Patent: Oct. 10, 2017

(54) METHOD FOR THE CREATION OF AN ELECTRONIC SIGNAL BOX REPLACING AN EXISTING SIGNAL BOX

(75) Inventors: Anton Gunzinger, Zurich (CH); Markus Montigel, Udligenswil (CH); David Mueller, Hinwil (CH); Markus Herrli, Bern (CH)

(73) Assignee: SUPERCOMPUTING SYSTEMS AG, Zürich (CH)

( * ) Notice: Subject to any disclaimer, the term of this patent is extended or adjusted under 35 U.S.C. 154(b) by 1263 days.

(21) Appl. No.: 13/378,337

(22) PCT Filed: Jun. 22, 2010

(86) PCT No.: PCT/CH2010/000160

§ 371 (c)(1),
(2), (4) Date: Mar. 30, 2012

(87) PCT Pub. No.: WO2010/148528

PCT Pub. Date: Dec. 29, 2010

(65) Prior Publication Data

US 2012/0182045 A1 Jul. 19, 2012

(30) Foreign Application Priority Data

Jun. 23, 2009 (CH) ..... 974/09

(51) Int. Cl.
*B61L 19/06* (2006.01)
*B61L 27/00* (2006.01)

(52) U.S. Cl.
CPC ..... *B61L 27/0072* (2013.01); *B61L 19/06* (2013.01); *B61L 2019/065* (2013.01)

(58) Field of Classification Search
CPC . B61L 19/06; B61L 2019/065; B61L 27/0072
(Continued)

(56) References Cited

U.S. PATENT DOCUMENTS 5,570,284 A * 10/1996 Roselli ..... B60L 3/12 246/187 C
5,922,034 A 7/1999 Feely
2007/0208841 A1* 9/2007 Barone ..... B61L 15/0027 709/223

FOREIGN PATENT DOCUMENTS

DE 4220696 A1 1/1994
DE 20 2005 016151 U1 2/2006
(Continued)

OTHER PUBLICATIONS

Mack H et al. "Einsatz und Moeglichkeiten der . . . ", Signal + Draht, vol. 88, No. 4, pp. 13-16, Apr. 1, 1996, ISSN 0037-4997, see International Search Report.
(Continued)

*Primary Examiner* — Zachary Kuhfuss
(74) *Attorney, Agent, or Firm* — Oppedahl Patent Law Firm LLC

(57) ABSTRACT

According to one aspect of the invention, the circuit logic of an existing relay interlocking system is mapped onto a functionally equivalent circuit of electronic components. Semiconductor components that are functionally identical to the components of the relay circuit are thus preferably used. The circuit logic is created, for example, by transforming an interlocking table or track diagram into a logic circuit by means of an automatic compiler according to predefined rules.

19 Claims, 3 Drawing Sheets

(58) Field of Classification Search
USPC ..... 326/38; 716/116
See application file for complete search history.

(56) References Cited

FOREIGN PATENT DOCUMENTS

| | | | |
|---|---|---|---|
| EP | 1273499 | A1 | 1/2003 |
| EP | 2090492 | A2 | 8/2009 |
| WO | 00/02760 | A2 | 1/2000 |
| WO | 03/070537 | A1 | 8/2003 |
| WO | 2005/113315 | A1 | 12/2005 |
| WO | 2006/051355 | A1 | 5/2006 |

OTHER PUBLICATIONS

Bahr D et al., "Speicherprogrammierbare Steuerungen . . . ", Nov. 1, 2008, pp. 6-14, vol. 100, No. 11, see International Search Report.
International Search Report in international application No. PCT/CH2010/000160, mailed Nov. 16, 2010.
European Patent Office , Office Action for 10 725 956.6, mailed Feb. 10, 2017.

* cited by examiner

METHOD FOR THE CREATION OF AN ELECTRONIC SIGNAL BOX REPLACING AN EXISTING SIGNAL BOX

The invention relates to signal boxes for rail transport. It relates particularly to a method for building an electronic signal box and to an electronic signal box.

A large proportion of signal boxes used today for rail transport are relay signal boxes, i.e. electric signal boxes. In relay signal boxes, the protection-oriented dependencies are produced entirely electrically by signal relays.

Maintenance and operation of these signal boxes can become increasingly costly and problematical. Furthermore, the integration of existing relay signal boxes into remote control and automation devices entails high levels of cost.

The relay signal boxes are therefore increasingly being replaced by electronic signal boxes. In electronic signal boxes, the protection-oriented dependencies are implemented by a piece of software in computers provided for this purpose. To this end, electronic signal boxes according to the prior art are based on a central computer on which the whole track diagram is mapped in the form of software. The appropriate software is correspondingly complex and needs to be customized and parameterized for each station specifically, which results in immense complexity for the certification.

Also for this reason, replacing relay signal boxes with electronic signal boxes requires great investment for the project planning, the new construction of the signal box and particularly for replacing the external installation and also the new certification.

WO 2005/113315 shows a control system for railway signal installations which is intended as a replacement for conventional relay-based systems. Processor units are used in order to perform the function of a respective unit in a relay signal box controller. The units used for this purpose are programmable processor cards which have a plurality of microprocessors and a memory. Like electronic signal boxes, this approach thus also involves microprocessors which execute commands set in a program; this is implemented such that the switching logic of a relay-based system is replaced equivalently. On account of the need to use microprocessors, the programmable processor units in WO 2005/113315 have the disadvantages of electronic signal boxes in terms of certification complexity, however—programmed processor systems are per se enormously complex, and jumps during the execution of a chain of commands on account of a single error can put the system into a totally different state, which may be a great risk with corresponding consequences for the certification.

The publication U.S. Pat. No. 5,922,034 shows a programmable device driver for railway signal installations. The device driver acts as an input and/or output unit for a particular function, for example a relay, a signal lamp, a motor, a switch, etc. It has a CPU and RAM memory. Different device drivers can be connected to one another in series; they are actuated by a central computer which can be regarded as an electronic signal box. The approach according to U.S. Pat. No. 5,922,034 also has the disadvantages of the system discussed above.

It is an object of the invention to provide a solution for replacing relay signal boxes which overcomes disadvantages of the prior art and, in particular, requires less substantial investment than solutions based on the prior art. According to the invention, the aim is to provide a method for building an electronic signal box and also an electronic signal box which allow relay signal boxes to be replaced by modern technology without the need to make excessive effort for changes and without the certification complexity becoming too great.

According to a first aspect of the invention, the switching logic in an existing relay signal box is mapped onto a functionally equivalent circuit of electronic parts. Thus, functionally identical/equivalent semiconductor chips are preferably used for the parts of the relay circuit.

The functionally equivalent circuit in this case is a configurable logic circuit, i.e. a circuit whose functional structure is configured. In contrast, by way of example, to computers or popular control systems—and also electronic signal boxes, for example—a sequence of commands which can be executed by a "generic" microprocessor and which is presented in a memory is thus not prescribed but rather a functional structure having interconnected blocks is configured.

The configuration of a configurable logic circuit is not to be confused with programming in the conventional sense, i.e. with the writing of software for a processor: in the case of a configurable logic circuit, circuit structures are produced using hardware description languages or in the form of circuit diagrams, and these structures are subsequently transferred to the chip for the purpose of configuration. This activates and/or deactivates particular switch positions in the configurable logic circuit. This results in a specifically implemented digital circuit which generally operates in highly parallel fashion, because each unit operates in parallel with the switch position. By contrast, even the fastest microprocessors execute few and usually no operations at all in parallel.

An important example of a configurable logic circuit is what is known as a 'Field Programmable Gate Array' (FPGA). Such an array may have memory cells (e.g. EEPROM, EPROM, SRAM, Flash) which store the configuration. Whenever it is started up, the configuration is transferred to the actual circuit. According to one alternative embodiment, the FPGA may also be permanently programmed by setting up the connections between the switching units permanently, for example using what is known as 'antifuse' technology.

FPGAs are often also considered to include Complex Programmable Logic Devices (CPLD), which are a further example of configurable logic circuits.

Thus, the approach of the invention does not strive to replace the relay circuit with a piece of software—although this works per se, it is associated with a high level of complexity for implementation—but rather the relay circuit is replaced by a semiconductor-based electronic circuit which provides the same functions and the same characteristics.

A functionally equivalent circuit can be obtained, according to one approach, if each input and output of the relay signal box switching logic has a corresponding input or output in the functionally equivalent circuit and an identical binary output is obtained for the same binary input.

In addition to the circuit which forms the logic unit, the signal box preferably has a plurality of input and/or output units which form the interfaces to the elements (points, signals, track release units, section block monitoring units) of the external installation. In many embodiments, these contain no 'intelligence' (i.e. no logic). In other embodiments, for example for particular signals, points, etc., they may also have functional logic. They are dependent on the type of element to be actuated and are used only for converting the logic signal into the physical actuation of the relevant element and hence, by way of example, for amplification and potential decoupling between the logic unit and the external installation. They may have a relay, an optocoupler and/or a contactor and/or other parts which are known per se. The input and/or output units may be arranged centrally in the signal box, i.e. in the building which houses the signal box and essentially at the location of the logic unit. This means that when the relay signal box is replaced it is ideally necessary to replace and install only components which are inside the building.

The approach according to the invention may also include the implementation of the circuit in a signal box.

The outputs of the functionally equivalent circuit are connected to the existing components to be actuated (points (controllers), signals, barriers (barrier controllers)) without the need for these to be significantly customized or even replaced.

In contrast to the prior art, the approach based on the aspect of the invention which is under discussion here thus distances itself from the inherently very powerful tool of software-based implementation of the logic unit and takes a step toward the supposedly more complex and less flexible implementation in the form of programmable hardware.

Although, in principle, the functionality of hardware electronics could also be provided by an appropriate piece of software, the inherently simple step made by the first aspect of the invention toward a circuit of electronic parts is of enormous advantage. This is because the use of software is always linked to the use of computer systems on which the software runs, and these are necessarily very complex. Even a simple modern computer has literally billions of transistors, different data memories, etc., and all of these parts are part of the signal box and must also be taken into account for the certification. A property of software-implemented systems, such as the systems based on the prior art which were cited at the outset, is that jumps occur during the sequential execution of a chain of commands. If an error (for example based on the influence of an ionizing particle) means that the jump address has an error then the system can be put into a totally different state, which can result in total failure. In a physically wired logic circuit, such jumps do not occur, on the other hand.

Therefore, although conventional software-based electronic signal boxes are very powerful tools in order to still meet appropriate safety requirements, they involve totally different principles than the relay signal boxes, and there is corresponding complexity involved in modification and particularly certification, which also covers all subsystems. By contrast, the approach based on the first aspect of the invention does not require fresh verification of the safety of the adopted relay switching logic mapped onto the configurable logic circuit, since this has already been verified.

The amazingly simple approach according to the invention allows the architecture of the relay signal box to be essentially retained, and therefore a substantial proportion of the project planning costs disappears, and the entire certification process can also be simplified. Furthermore, the signal box can be implemented using programmable chips such that only minor changes need to be made to the external installations. Maintenance is significantly less complex than in the case of conventional relay signal boxes. Finally, remote control and automation tasks and integration into superordinate systems, for example into a remote control system, or into subordinate systems, for example the ETCS (European Train Control System), can be performed relatively easily by the logic chips used.

A further advantage over electronic signal boxes is the speed. In comparison with the software in a conventional electronic signal box, the signal box designed according to the first aspect of the invention, with the logic circuit, switches faster by orders of magnitude.

By way of example, the first aspect of the invention can be used for relay signal boxes based on the interlocking plan principle but also for relay signal boxes based on the track plan principle. On account of the advantages of the approach according to the invention over electronic signal boxes, the signal box to be replaced may also be a software-based electronic signal box the core function of which (binary output as a function of the binary input) is likewise replaced by a fixed electronic circuit of semiconductor parts (generally at least one FPGA or a comparable chip).

According to a second aspect of the invention, the architecture of a circuit which is functionally equivalent to the relay signal box is produced by transforming an interlocking plan or a track plan into a logic circuit using an automatic translator. In this case, the interlocking plan or the track plan may be in the form of a drawing, a table or in another technical form.

The automatic translator may be in the form of a piece of computer software which uses explicit, predefined specifications to assign an electronic circuit to the interlocking plan/track plan. The specifications can therefore be reconstructed at any time and may be in a form such that they meet the requirements of safety-related systems. They can also be checked by an office which is responsible for the certification.

A similar approach can also be chosen for software-based electronic signal boxes which are to be replaced, with a correspondingly alternative translation program, oriented to the input/output logic of the software, being used for the circuit layout of the logic circuit into which the logic is transformed.

It is particularly favorable to combine the first aspect of the invention with the second aspect.

In order to verify the correctness of a logic circuit obtained by transformation, said circuit can optionally be transformed back into a comparable form for the original interlocking plan/track plan again using a reverse translation algorithm. The comparison between interlocking plan/track plan and back-transformed comparison plan may be part of the safety-related check.

According to a first embodiment, the reverse transformation is followed by a user (for example a railway specialist) performing the comparison between the original interlocking plan V/S and the comparison plan V'/S' obtained by reverse transformation. The comparison plan V'/S' is then again presented in the same way as the original interlocking plan/track plan V/S was presented, for logical reasons. It thus makes sense for a drawing to involve similar presentation, for example, with the same local position in the presentation or the same numbering or labeling, for example, or for the same names to be used when using names for variables or signals. In order to simplify this mapping, the translator produces metadata which are then again used for the reverse transformation. It goes without saying that these metadata do not perform any functional task; they are used merely to make the comparison plan V'/S' more readable for humans.

According to a second embodiment, the comparison between the interlocking plan/track plan and the comparison plan can be performed by the computer.

By way of example, the signal box has—as is known per se—a logic unit and input/output units, the characteristics of which correspond to those of the replaced relay signal box, as mentioned. The logic unit preferably has at least one communication input for control, automation, ETCS, etc. The logic unit is preferably free of microprocessors, i.e. of freely programmable units, in the core (i.e. in the elements which ascertain a binary output from a binary input).

The logic unit may have supplementary systems which always ensure that the current logic function corresponds to the original logic function, for example ascertained by the aforementioned translation.

As mentioned, the input/output units of the electronic circuit preferably have similar connecting structures for the external installations (points controllers, signals, barrier controllers, etc.) to the replaced relay units. It is likewise preferred for the input/output units to have similar external dimensions to the relay units. Each of the preferred features can help to ensure that only minor changes, or no changes at all, need to be made to the external installations.

According to a first embodiment, the architecture of the electronic circuit and of the input/output units can provide for the logic unit to be connected to the input/output units in a star shape.

In a further possible architecture, the logic function L is connected to the input/output units in a ring shape. This simplifies the wiring, in particular. The ring may be in the form of a parallel or serial system, in electrical or optical form, with or without error correction, one-way or two-way. The possible forms of the communication have different costs and different properties: for example, an optically conducted ring may have a large extent. Two-way communication has a certain level of error redundancy.

Naturally, combinations between star and ring architectures are also conceivable, for example a plurality of subunits each with one or more input/output units which are connected to one another in a ring shape, the connection between the logic unit and the subunit being in a star shape.

Serial systems usually involve the use of data packets which are transmitted periodically. It is therefore a technically simple option to monitor and then record (store) this system state in a logging unit (for example a separate "black box"). This means that all processes can later be analyzed by a computer which is connected directly to the "black box" B. This analysis can usefully also take place during operation.

In order to increase the safety of the system, it is also possible for two logic units to be connected in series. In this case, the first and second logic units are preferably of identical design and have identical control inputs. In a normal operating situation, the signals from both logic units should be identical. If they are not identical, there is an error in one of the logic units, or in one of the superordinate systems. In this case, the input/output units can enter a "safe state" (e.g. change signal to red) and/or trigger an alarm. If appropriate, the alarm can naturally also be triggered by the "black box" B.

Embodiments of the invention are described in more detail below with reference to schematic drawings, in which identical reference symbols (identification letters) denote the same or similar elements and in which.

Figure 3:
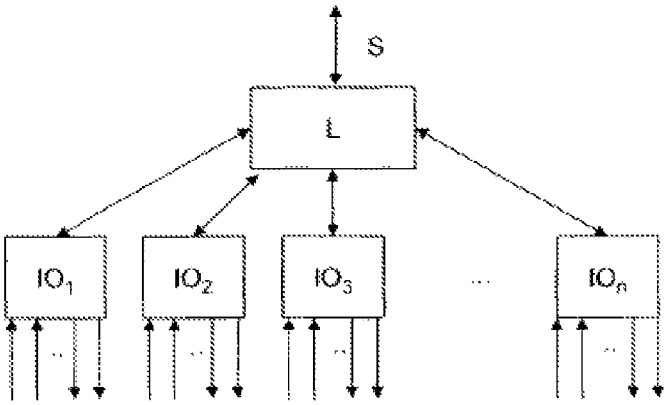
FIG. 3 shows a first embodiment of the architecture of the electronic circuit.
Figure 3A:
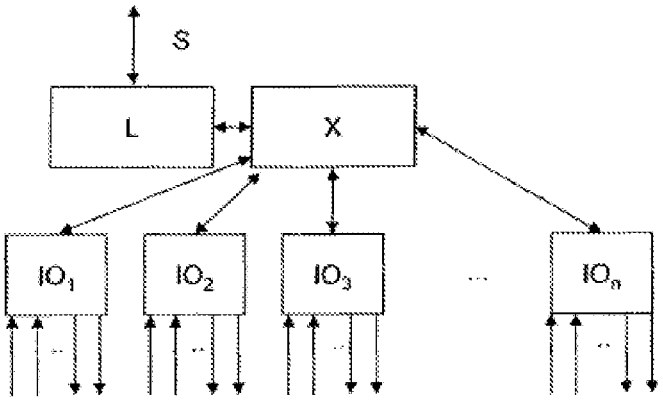
Figure 4:
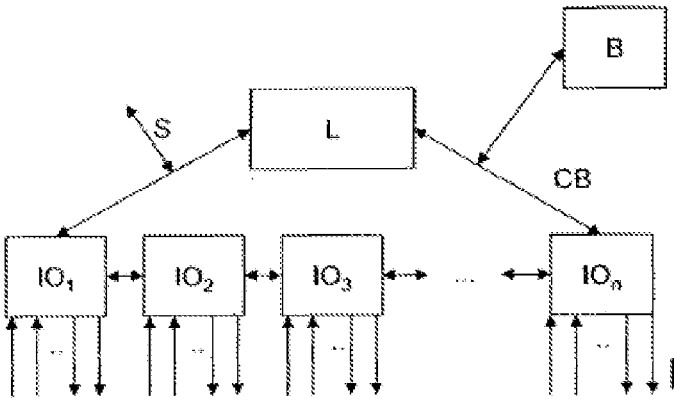
Figure 5:
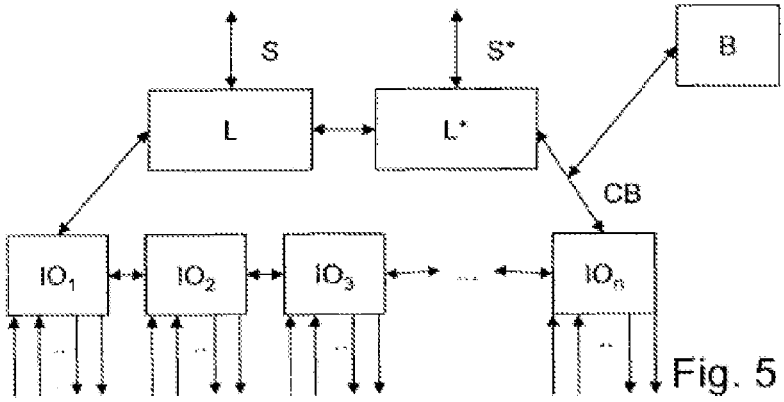
Figure 6:
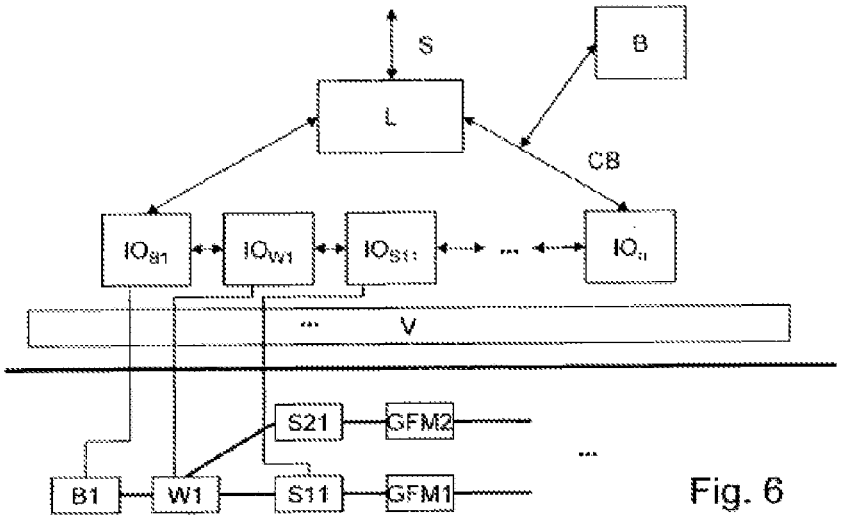
Figure 7:
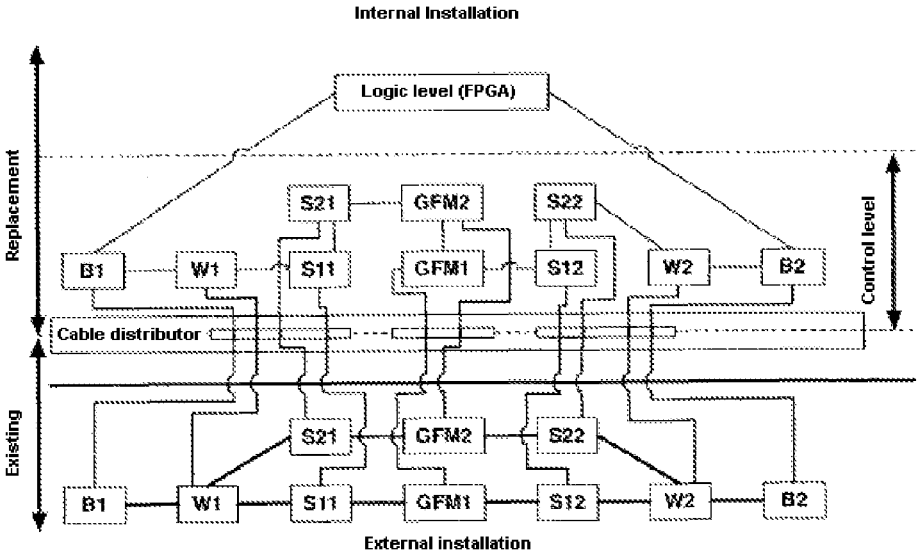

FIG. 3*a* shows a variant of the embodiment shown in FIG. 3;

FIG. 4 shows a further, alternative embodiment of the architecture of the electronic circuit;

FIG. 5 shows a variant of the embodiment shown in FIG. 4, with two logic units; and FIG. 6 takes the embodiment shown in FIG. 4 as a basis for schematically showing the connection to elements of the external installation; and FIG. 7 shows an example of a signal box architecture of the type according to the invention.

Figure 1:
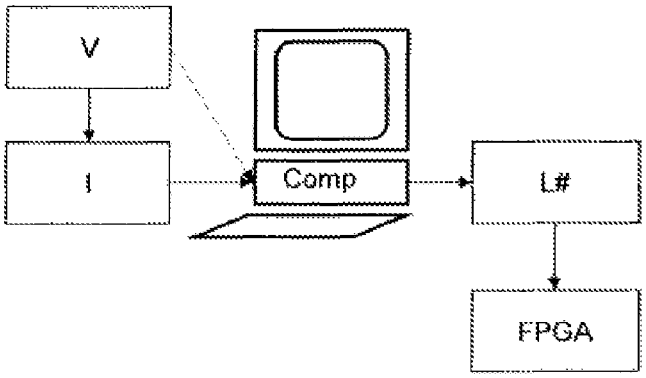
FIG. 1 shows a method according to the first aspect of the invention for building an electronic signal box.

As FIG. 1 shows, an interlocking plan V (or a track plan S, not shown) is captured by a computer Comp, for which a special input unit I may optionally be provided. The input unit may, if appropriate, be attuned to the format of the interlocking plan and may have a scanner and also an appropriate piece of software for recognizing and capturing the symbols in the interlocking plan, for example. It goes without saying that the interlocking plan may also already have been in electronically readable form from the outset. From the captured interlocking plan, the computer Comp produces a logic function L#. The logic function corresponds to the electronic representation of a logic circuit. It is mapped onto a physical logic circuit which is implemented in a programmable logic chip (FPGA).

Figure 2:
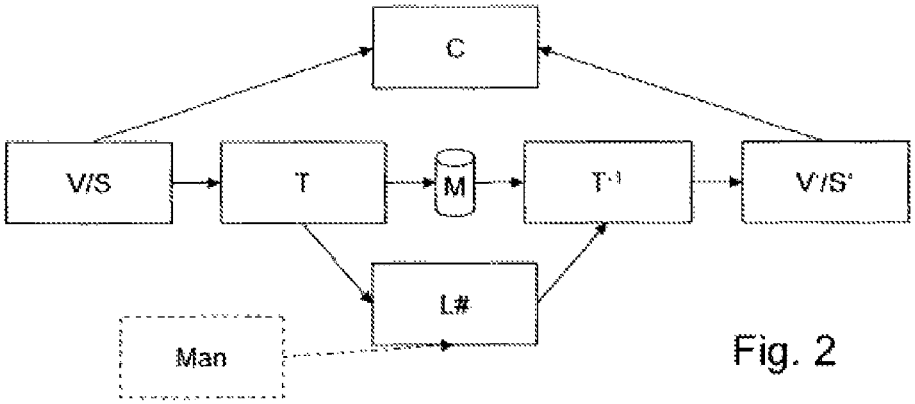
FIG. 2 shows a method according to the second aspect of the invention for designing a logic circuit for an electronic signal box.

The method for producing the logic function L# from the interlocking plan V (or a track plan S) is shown schematically in FIG. 2 in a specific embodiment which allows verification. From the interlocking plan V or the track plan S, a suitable translation program T will ascertain the logic function L#. In the embodiment shown here, the translation program also creates a file M containing metadata, which are not safety-related and, by way of example, contain information relating to the presentation of the interlocking plan. In order to allow verification, a reverse translation program $T^{-1}$ produces a comparison plan V'/S' from the logic function L# using 'Reverse Engineering', said comparison plan being designed, on the basis of the metadata, such that, by way of example, a similar presentation is made or the same names are used when using names for variables or signals. The comparison C is performed by a checking person or can alternatively also be performed by the/a computer, in which case the metadata can also be made available to the comparing program instead of being used for producing the comparison plan V'/S'.

In specific instances—for example in the event of a nonstandard signal location—a user can use an appropriate manually controllable input option (Man) to perform manual customization.

The implementation of a logic function L# on an FPGA, which is then equipped as a logic unit, is known per se.

As a variant of the method described above, it is also possible to reverse engineer the implemented logic unit L instead of the logic function L#.

FIG. 3 shows a star-shaped connection between the logic unit L (on which the logic function L# is implemented) and the input/output units $IO_1 \ldots IO_n$. As mentioned, in all embodiments, the input/output units preferably have similar dimensions to the original relay units and also have similar connecting structures to the external installations, which means that only minor changes or no changes at all need to be made to the external installations.

The reference symbol S denotes a communication input for the communication with an input unit and/or with a superordinate system.

In a variant which is shown in FIG. 3*a*, the logic unit L is likewise connected to the input/output units in a star shape; however, this is done via a switch X.

The architecture shown in FIG. 4 is a ring-shaped architecture. The logic unit L is connected to the input/output units $IO_1 \ldots IO_n$ in a ring shape. Whereas the wiring in a star-shaped architecture is designed to be parallel (even a parallel architecture allows the optional use of serial protocol), it may be of either parallel or serial design in the case of a ring-shaped architecture. In the exemplary embodiment shown, the communication is serial, i.e. the data packet transmitted by the logic unit, for example periodically, contains data which contain the overall system state (switching state of each component to be actuated). Each input/output unit is addressed and takes the information it requires from the data packet. Since each data packet contains all the information, it is also suitable for monitoring the system and/or logging. For this purpose, the signal is also forwarded to a "black box" B via the communication system CB. There, the successively arriving data packets are stored and/or analyzed, usefully during operation.

A further interface allows the communicated state to be reliably transmitted to management systems or, for operation under ETCS, to the 'Radio Block Center' (RBC). The same path can be used to transmit routes which are requested by the management system or by an automation element to the digital signal box.

Besides the logic unit L, the embodiment shown in FIG. 5 has a second, functionally equivalent and possibly identical, logic unit L*. The control inputs S, S* of the logic units are also identical and are actuated in identical fashion. The control signals from L and L* are forwarded to the input/output units $IO_0 \ldots IO_n$. by the communication system CB. In the normal operating situation, the signals from L and L* should be identical. If they are not identical, there is an error in one of the logic units L or L*, or in one of the superordinate systems S or S*. In this case, the input/output units $IO_0 \ldots IO_n$ can enter a "safe state" (e.g. change signal to red) and trigger an alarm. The alarm can naturally also be triggered by the "black box" B.

Embodiments having two logic units which ensure redundancy can, per se, also be used for star architectures or mixed architectures.

As a special safety feature of embodiments which are preferred in many cases, it is possible to use a different make, which is not of identical design to the logic unit L, sometimes from a different supplier, for the logic unit L* than for the logic unit L. This results in diversitary redundancy.

It is a great advantage of the course of action according to the invention based on all aspects of the invention that the logic unit can be implemented by a comparatively simple means on account of the approach according to the invention. This provides the first opportunity to have the approach to two logic units operating in parallel totally independently of one another, which would be virtually impossible in the case of electronic signal boxes, for example. This in turn allows the diversitary redundancy which is often very desirable in safety engineering.

By way of example, the independence of the two logic units can mean that the logic units do not exchange interim results, or even that no signals at all from one control unit are processed by the other control unit.

FIG. 6 uses the example from FIG. 4 to schematically show the connection to the external installation. The black line printed in bold symbolizes the boundary between the building which contains the signal box and the "outside". The input and/or output units are each associated with an actuating element of the external installation, for example the unit $IO_{B1}$ is associated with the block B1, the unit $IO_{W1}$ is associated with the points W1, the unit $IO_{S11}$ is associated with the signal S11, etc. The interface between the existing cabling of the external installation and that of the replaced signal box forms a cable distributor V, which is likewise preferably inside the building.

FIG. 7 shows an example involving a simple external installation with the rail progression shown at the bottom of the figure. The boxes B1 and B2 in the lower half of the figure denote the route blocks 1 and 2, W1 and W2 denote points, Sij are signals, and GFM1 and GMF2 are track release units. In the upper half of the figure (in the internal installation), the correspondingly labeled boxes denote the input and/or output units associated with the respective elements.

In the example shown here, the cabling of the logic unit (FPGA) in a ring architecture with the input and/or output units is of serial design as an Ethernet bus. The external cabling running away from the cable distributor to the outside can be adopted in unaltered form from the relay signal box.

The invention claimed is:

1. A method for setting up an electronic signal box as a replacement for an existing signal box, comprising the steps of:

providing the existing signal box, the existing signal box being connected to components to be actuated for the rail transportation and to actuate said components, the existing signal box having a switching logic, providing the switching logic of the existing signal box in an electronically readable form, mapping, by means of a transformation, the switching logic onto a logic function that corresponds to the electronic representation of a logic circuit, that is functionally equivalent with the switching logic, using the representation to physically configure a configurable logic circuit being a circuit of electronic semiconductor parts, whereby the switching logic of the existing signal box is physically mapped onto the functionally equivalent configurable logic circuit by means of the transformation, and connecting outputs of said configurable logic circuit to at least some of the existing components to be actuated; and whereby the configurable logic circuit actuates the components to be actuated without the use of a processor.

2. The method as claimed in claim 1, wherein the configurable logic circuit comprises at least one Field Programmable Gate Array (FPGA).

3. The method as claimed in claim 1, wherein the outputs of said circuit are connected to the components to be actuated via component-specific input and/or output units without integrated logic or with integrated logic.

4. The method as claimed in claim 1, wherein the signal box to be replaced is a relay signal box.

5. The method according to claim 1, wherein the electronically readable form comprises an interlocking plan or a track plan for the relay signal box.

6. The method as claimed in claim 5, comprising the further steps of translating the logic circuit back into a comparison plan, by applying inverted rules, and of comparing the interlocking plan (V) or track plan (S) with the comparison plan.

7. The method as claimed in claim 6, comprising the further step of producing related metadata and wherein the step of translating back involves the metadata being used in order to present the comparison plan so as to be able to be compared with the interlocking plan.

8. The method as claimed in claim 1, wherein the logic circuit has a logic unit and a plurality of input and/or output units, wherein the logic circuit is connected to the input and/or output units in a star shape.

9. The method as claimed in claim 1, wherein the circuit has a logic unit and a plurality of input and/or output units, wherein the logic circuit is connected to the input and/or output units in a ring architecture, with communication taking place simultaneously in both directions along the ring.

10. The method as claimed in claim 9, wherein the communication takes place in data packets which each represent the overall state of the system, wherein the communication takes place periodically.

11. The method as claimed in claim 10, wherein comprising the further step of recording the communication by an observer unit.

12. The method as claimed in claim 1, wherein the logic circuit has two redundant logic units which both execute the same logic function and output the results, respectively, wherein, if the results do not match, a safe state is entered and/or an alarm is triggered.

13. An electronic signal box as a replacement for an existing signal box for a rail transportation, wherein the existing signal box is connected to components to be actuated for the rail transportation before the existing signal box is replaced by the electronic signal box and includes a switching logic physically mapped onto hardware, the electronic signal box comprising an electronic logic unit comprising a configurable logic circuit and a plurality of input and/or output units for actuating the components, the input and/or output units connected to at least some of the components, wherein the configurable logic circuit is a circuit of electronic semiconductor parts functionally equivalent to the switching logic of the existing signal box, and whereby the configurable logic circuit actuates the components to be actuated without the use of a processor.

14. The signal box as claimed in claim 13, wherein the at least one configurable logic circuit is a Field Programmable Gate Array (FPGA).

15. The signal box as claimed in claim 13, wherein the logic unit is free of microprocessors.

16. The signal box as claimed in claim 13, further comprising a second logic unit which is functionally equivalent to the logic unit, wherein the logic unit and the second logic unit both output control signals to the input and/or output units, respectively.

17. The signal box as claimed in claim 16, wherein the second logic unit has at least one property different from a corresponding property of the first logic unit.

18. The method as claimed in claim 1, wherein physically configuring the configurable logic circuit comprises at least one of:

activating particular switch positions in the configurable logic circuit;

de-activating particular switch positions in the configurable logic circuit.

19. The signal box as claimed in claim 13, wherein the switching logic is stored in a memory.

* * * * *